United States Patent [19]

Bontomase et al.

[11] Patent Number: 4,902,014

[45] Date of Patent: Feb. 20, 1990

[54] GOLF PUTTER WITH SIGHTING DEVICE

[76] Inventors: Anthony J. Bontomase, 7586 Rome Rd.; David A. Bontomase, Rt. 3, R.D. #2, both of Pulaski, N.Y. 13142

[21] Appl. No.: 213,366

[22] Filed: Jun. 30, 1988

Related U.S. Application Data

[63] Continuation-in-part of Ser. No. 81,699, Oct. 5, 1987, abandoned.

[51] Int. Cl.[4] ..... A63B 69/36; A63B 53/04

[52] U.S. Cl. ..... 273/162 B; 273/171; 273/167 J; 273/186 A; 273/167 H

[58] Field of Search ..... 273/162 B, 171, 167 J, 273/186 A, 172, 173, 174, 167 F, 169, 167 H, 193 R, 194 R, 194 A, 194 B

[56] References Cited

U.S. PATENT DOCUMENTS 1,133,129 3/1915 Govan ..... 273/171
3,242,582 3/1966 Garrett ..... 273/162 B
3,909,004 9/1975 Vella ..... 273/162 B

*Primary Examiner*—George J. Marlo
*Attorney, Agent, or Firm*—Charles C. McGuire

[57] ABSTRACT

A golf putter with sighting device comprising a putter blade attached to a standard shaft and handle. The blade includes an essentially planar surface with a circular threaded cavity which is of sufficient depth to receive a cylindrical threaded core of substantially the same cross dimensions as said cavity including two essentially planar ends, one of such ends including a circular liquid level. The core may be invertedly threaded into the cavity such that either end of the core may be exposed upon the blade surface. It is intended that the level containing end be exposed for practice play and then invertedly threaded back into the cavity such that it is now embedded within the cavity and now qualified for regulation play with no depreciable effect to the putter, such as a shift in weight.

7 Claims, 1 Drawing Sheet

GOLF PUTTER WITH SIGHTING DEVICE

REFERENCE TO RELATED APPLICATION

The present application is a continuation-in-part of application Ser. No. 81,699, filed Oct. 5, 1987 now abandoned, of the same inventors.

BACKGROUND OF THE INVENTION

This invention relates to sighting devices for golf putters and more particularly to an improved and novel golf putter which incorporates a uniquely mounted liquid level which permits use of the putter in regulation play as well as for practice use.

The putter is the golf club used primarily on the green for striking the ball to roll over the green surface toward the hole. Thus, precise and delicate alignment of the club and ball is required and, therefore, more accurate eye measurements must be made by the golfer. Such measurements include keeping the putter blade lined up in a horizontal plane while the front face is arranged in a plane at right angles to the target line, or intended initial direction of the ball and toward the hole. These measuring criteria should be maintained throughout the full swing of the club by the golfer to secure a successful putt.

Devices to aid the golfer make such difficult occular measurements and coordinated hand and arm movements have come forth in a variety of forms. One such form is the use of a liquid or bubble-type level incorporated into the putter blade to help make proper adjustments for the slope of the green, as does this invention; however, none so far have disclosed an embodiment which may be used for both regulation and practice play with no depreciable effect to the putter, such as a shift in weight. That is, conventional rules prohibit moving parts, which would include the bubble of a level, in a visible position on a golf club during regulation play, although such devices may be used for practise.

For example, U.S. Pat. Nos. 2,995,375, 2,919,922, and 2,976,046 issued to Bukovey, Skelly, and McCullough, respectively, all disclose a golf putter which incorporates a level measuring one horizontal axis in the putter blade. All such levels are permenantly placed into the blade and are therefore inadequate for regulation play or, if removed, substantially detract from the weight distribution of the putter thereby negating any advantage that was gained while using the level in practise putting.

Another form of the same idea incorporates the level on the shaft of the club, but problems such as the adverse effect on the natural balance of the club are clearly evident.

OBJECTS AND ADVANTAGES

It is therefore a main object of the present invention to provide a golf putter which incorporates a liquid level in the putter blade which may be used for regulation as well as practice play.

It is a further object to provide a level incorporated into a golf putter blade which is effective for 360 degree club alignment, thereby providing improved measuring indicia for the golfer.

Still another object is to provide a golf putter including a visually observable leveling device in which the golfer may adjust the weight of the putter blade to accomodate his or her particular needs.

Other objects will in part be obvious and in part appear hereinafter.

SUMMARY OF THE INVENTION

According to the invention there is provided a sighting device for a golf putter which is removably threaded into a threaded cavity in a substantially planar surface of a putter blade such that the device may expose a first end including a liquid level affixed thereon for practice purposes. Conversely, the device may be invertedly threaded into the cavity such that the second or opposite end, having a substantially planar surface such that it is substantially flush with the upper putter blade surface. The level-containing end is then concealed within the putter blade such that it is out of sight, thereby rendering the club acceptable for regulation play.

The sighting device comprises a cylindrical, externally threaded, metallic core with substantially planar surfaces at each opposite end, one such end including a circular liquid level of substantially the same diameter as the core affixed thereon. The circular liquid level includes a "target circle" inscribed at the center of the level such that the bubble in the liquid will appear in the target circle when the putter blade is lined up, front-to-rear in a horizontal plane and the front or putting face is arranged in a plane at right angles to the target line of initial travel of the ball toward the hole.

The putter blade upper planar surface includes an internally threaded cavity of substantially the same diameter as the metallic core and of sufficient depth to receive the core such that the exposed core surface is substantially flush with the putter blade upper surface. Some space will remain at the bottom of the cavity such that a predetermined number of circular weight "chips" or slugs may be added if the golfer so desires. A standard putter shaft is attached on the upper surface of the blade behind the cavity.

The putter blade is preferably configured to keep the overall weight of the putter at a minimum, i.e., the bottom middle surface and the front and back ends' sides are carved out such that there is a minimum amount of metal from which the putter blade is configured. The hitting surface of the blade includes a protruding "sweet spot" of substantially the same length as the diameter of a golf ball. It is this so called sweet spot, which is usually midway the length of the putter blade, where the ball should be struck to secure a successful putt.

DETAILED DESCRIPTION

Figure 1:
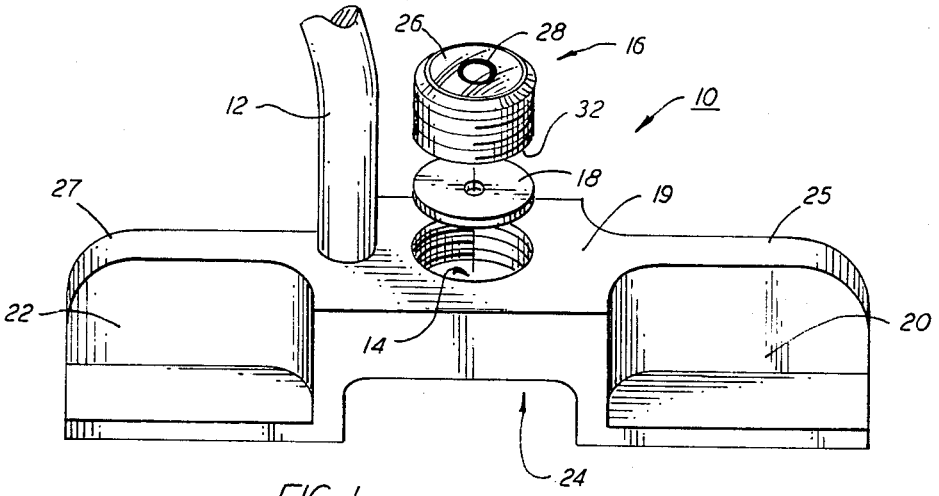
FIG. 1 is a rear perspective view of the preferred embodiment of the invention showing the putter blade with the sighting core in exploded view with the liquid level exposed on the upper surface thereof.
Figure 2:
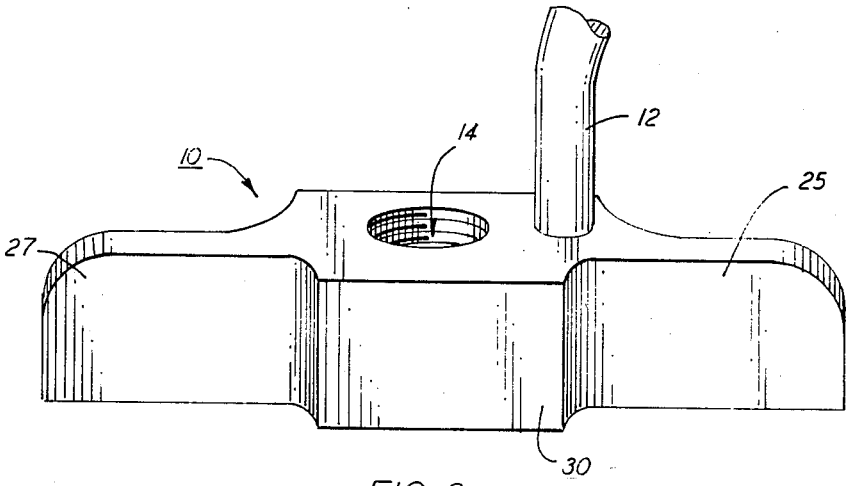
FIG. 2 is a front perspective view of the putter of FIG. 1 showing the core-receiving cavity on the upper surface of the putter blade and the protruding "sweet-spot" on the front surface.

Referring now to the drawing, in FIGS. 1 and 2 is shown a putter blade denoted generally by reference numeral 10 attached to an elongated shaft, a portion of which is denoted by reference numeral 12. The upper surface 19 of the blade includes a circular, internally threaded cavity 14 of sufficient depth to receive a cylindrical, externally threaded core 16 of substantially the same diameter as the cavity 14, and an additional predetermined number of weight "chips" or slugs 18 to adjust the weight of the putter blade for the user's particualr needs.

In the preferred embodiment of the invention, the putter blade 10 includes a front "toe" portion 25 with carved out area 20 and back "heel" portion 27 with carved out area 22 while the bottom face or sole (not shown) of the putter blade 10 is in an essentially horizontal plane. The carved out protion 24 in the middle bottom face of the blade extends approximately half the width of the putter blade as is evidenced by the protruding sweet-spot on the opposite or ball hitting side of the blade, denoted by reference numeral 30 in FIG. 2. The length of the sweet-spot 30 from edge to edge is preferably about the same as the diameter of the usual golf ball which is approximately one an five-eights inches, thus assisting in alignment of the ball with the putter sweet spot.

Figure 3:
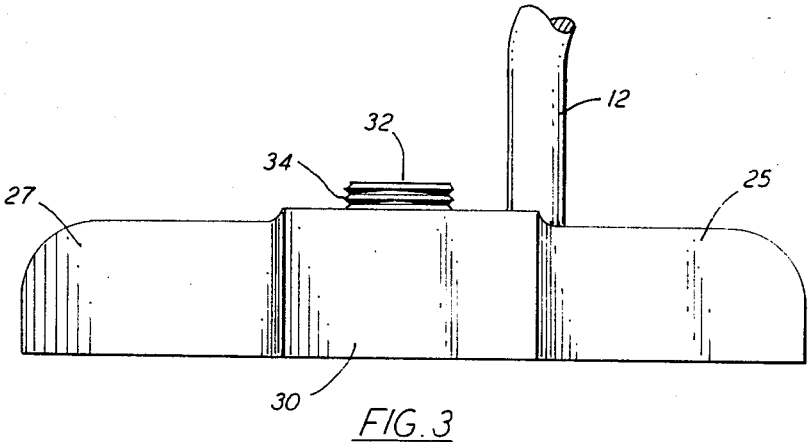
FIG. 3 is a front elevational view of the putter of FIG. 1 showing the opposite, essentially planar surface end of the sighting core threadedly engaged within the putter blade upper surface.

The cylindrical core 16 of FIG. 1 has essentially planar opposite ends, one such end including a circular liquid level 26 of essentially the same diameter as the core 16. A "target circle" 28 is inscribed at the center of the level 26 such that when the putter blade 10 is properly aligned to secure a successful putt, as aforementioned, the bubble in the level will appear inside the target circle 28. The opposite planar end of the core 16 is shown in FIG. 3 and denoted by numeral 32 including threaded portion 34.

During practice play it is intended that the core 16 will be manually threaded into the cavity 14 such that the level 26 is substantially flush with and threrefore exposed upon the upper planar surface 19 of the putter blade 10. A predetermined number of weight chips 18 may be placed first into the cavity 14 before the core 16 is threadedly engaged therein, if so desired. The circular liquid level 26 will measure a full 360 degree radii such that the golfer enjoys a substantial increase from which he or she may determine if the putter blade is properly aligned to secure a successful putt, i.e., by keeping the bottom horizontal face or sole of the putter blade 10 lines up in a horizontal plane and the front or sweet-spot face 30 arranged in a plane at right angles to the target line between the ball and hole. During the swing of the putter, the bubble in the level should travel in a line which is substantially parallel to the target line between the ball and the hole to achieve a successful putt.

In going from practice play to regulation play it is intended that the golfer manually unthreaded the core 16 form the cavity 14, by first grasping the threaded portion 34 exposed upon the upper planar surface 19 of the putter blade 10 and commence turning the core 16 in a counter-clockwise direction until removed from the putter blade 10. The golfer then inverts the core 16 such that the planar surface end 32 will be exposed on the upper planar surface 19 of the balde 10 upon manually threading the core 16 back into the cavity 14. In this circumstance, the level 26 will be embedded within the cavity 14 such that it is no longer in sight, the putter now being qualified for regulation play with no adverse effect upon the putter, such as a shift in weight. Thus, the increased skill gained by use of the level device during practise may be carried over to regulation play with the same putter.

What I claim is:

1. A golf putter including a sighting device comprising, in combination:

(a) a golf putter blade having an essentially planar upper surface attached to an elongated shaft with handle portion;

(b) a circular, internallly threaded cavity extending into said blade upper planar surface;

(c) a cylindrical, externally threaded core of substantially the same diameter as said said cavity and including two essentially planar end surfaces; and (d) a circular liquid level of substantially the same diameter as, and affixed to one of said end surfaces of, said core.

2. The invention according to claim 1 wherein said circular threaded cavity is of sufficient depth to receive said threaded core such that said core is substantially flush with said blade planar surface.

3. The invention according to claim 2 wherein said cavity is of sufficient depth to receive an additional predetermined amount of circular weight slugs before the receival of said core.

4. The invention according to claim 1 wherein said golf putter blade includes a protruding sweet-spot portion on said blade's hitting face, the edge to edge length of which approximately equals the diameter of a standard golf ball.

5. The invention according to claim 1 wherein said core is manually threaded into said cavity with said core liquid level surface exposed upon said blade planar surface for practice play.

6. The invention according to claim 5 wherein said core may be manually unthreaded and invertedly threaded back into said cavity such that said level containing surface is embedded within said cavity thereby qualifying said putter for regulation play.

7. The invention according to claim 1 wherein said circular liquid level includes an inscribed target-circle at the center such that the bubble in the liquid will appear in said target circle when said putter blade is lined up in a horizontal plane with the blade's front face arranged in a plane normal to the target line of initial travel of the ball.

* * * * *